United States Patent [19]

Lamb et al.

[11] Patent Number: 4,671,894

[45] Date of Patent: Jun. 9, 1987

[54] LIQUID DETERGENT COMPOSITIONS

[75] Inventors: Christopher Lamb; John R. Lawson, both of Newcastle upon Tyne; Carol Pearson, Wilmslow, all of England

[73] Assignee: The Procter & Gamble Company, Cincinnati, Ohio

[21] Appl. No.: 794,869

[22] Filed: Nov. 4, 1985

[30] Foreign Application Priority Data

Nov. 7, 1984 [GB] United Kingdom ..... 8428149

[51] Int. Cl.[4] ..... C11D 1/831; C11D 1/92

[52] U.S. Cl. ..... 252/545; 252/546; 252/547; 252/548; 252/550; 252/551; 252/553; 252/559; 252/DIG. 14

[58] Field of Search ..... 252/541, 546, 547, 545, 252/553, 559, DIG. 14

[56] References Cited

U.S. PATENT DOCUMENTS

| | | | |
|---|---|---|---|
| 4,329,334 | 5/1982 | Su et al. | 424/70 |
| 4,435,317 | 3/1984 | Gerritsen et al. | 252/547 |
| 4,544,495 | 10/1985 | Schmolka | 252/174.21 |
| 4,554,098 | 11/1985 | Klisch et al. | 252/547 |
| 4,555,360 | 11/1985 | Bissett et al. | 252/541 |
| 4,595,529 | 6/1986 | Lai | 252/545 |

FOREIGN PATENT DOCUMENTS

| | | |
|---|---|---|
| 0039110 | 11/1981 | European Pat. Off. . |
| 2361080 | 6/1974 | Fed. Rep. of Germany . |
| 38508 | 3/1977 | Japan . |
| 1524441 | 9/1978 | United Kingdom . |
| 2010893 | 7/1979 | United Kingdom . |
| 1551074 | 8/1979 | United Kingdom . |

*Primary Examiner*—Prince E. Willis

*Attorney, Agent, or Firm*—Robert B. Aylor; Richard C. Witte; Thomas H. O'Flaherty

[57] ABSTRACT

Stable liquid dishwashing detergent compositions are provided incorporating an alkyl benzene sulfonate and/or alkyl sulfate, an alkyl ethoxy sulfate, an ethoxylated $C_6$–$C_{13}$ alcohol containing an average of from 3 to 12 moles of ethylene oxide and wherein the ethoxylated alcohol contains no more than 1% by weight of unethoxylated alcohol and a zwitterionic surfactant containing a $C_{10}$–$C_{16}$ alkyl group.

7 Claims, No Drawings

LIQUID DETERGENT COMPOSITIONS

FIELD OF THE INVENTION

This invention relates to aqueous liquid detergent compositions and particularly to dishwashing compositions incorporating a mixture of anionic, ethoxylated nonionic and zwitterionic surfactants.

BACKGROUND OF THE INVENTION

Liquid detergent compositions intended for use as dishwashing products conventionally take the form of clear aqueous solutions containing a mixture of one or more sulphate and sulphonate anionic surfactants together with a suds stabilising agent. Recently there has been a trend towards the use of magnesium cations for at least part of the anionic surfactants present, typified by the disclosures of British Patent Specifications Nos. 1,524,441 and 1,551,074, British published Patent Application No. 2,010,893 A and European Patent Application Publication No. 0039110. The art teaches that these formulations have enhanced performance, particularly when used in water of low mineral hardness. Nevertheless, the pressure to improve the cost-effectiveness of liquid detergent compositions has meant that the search has continued for compositions having improved economy, performance and in-use characteristics. In particular, intensive effort has been expended in increasing the concentration of dishwashing liquid detergent compositions and in reducing the level of non-performing ingredients such as solvents and solubilising hydrotropes without sacrificing the storage stability of the compositions.

Ethoxylated nonionic surfactants constitute a class of materials capable of solubilising other components in aqueous media but this capability is strongly dependent on their average degree of ethoxylation ($E_{av}$). Highly ethoxylated nonionic surfactants, (i.e. $E_{av}>20$), are very hydrophilic in nature and thus tend to reduce the oily soil removal capability of liquid dishwashing detergent formulations, which is undesirable where oil and grease removal is an important criterion of consumer acceptance. On the other hand nonionic surfactants having low levels of ethoxylation (i.e. $E_{av}\leqq 2$) are relatively hydrophobic and have a limited ability to form homogeneous solutions with other components in the absence of other surfactant species.

A feature shared by all ethoxylated nonionic surfactants is the present of a level of unethoxylated material, the magnitude of which depends on the degree of ethoxylation, but which can constitute up to 20% by weight of the nonionic surfactant. Unethoxylated $C_6$–$C_{13}$ aliphatic primary alcohols are odorous materials having a low water solubility, and these characteristics are discernible in the ethoxylated alcohols to an extent which depends on the level of ethoxylation, the effect diminishing as $E_{av}$ increases.

Liquid dishwashing detergent compositions containing alkyl sulfates and/or alkyl benzene sulfonates have been found to be particularly subject to odour and storage stability problems when formulated with ethoxylated nonionic surfactants containing the normal spread of ethoxylated species, and this effect is more pronounced when the composition also contains magnesium ions. However, the Applicants have established that certain alcohol ethoxylates, containing less than a defined amount of unethoxylated species, and from which preferably at least part of the mono-ethoxylated species has been removed, can be incorporated in alkyl benzene sulfonate- or alkyl sulfate-containing liquid dishwashing detergent compositions without adverse effect on the storage stability of the latter. The Applicants' copending European Application No. 84303044.6 publication No. 0125854 relates to liquid dishwashing detergent compositions of this type.

Zwitterionic surfactants are also known components of detergents compositions particularly in combination with other surfactant species. Disclosures of compositions of this type are provided by European Patent Application Publication No. 0036625 and UK Patent Application No. 2103236A, both of which relate to liquid detergent compositions containing mixtures of alkyl ethoxy sulfate sin combination with other anionic surfactants and a surface active betaine. Another disclosure is provided by Thiele et al. U.S. Pat. No. 3,634,266 which describes an amylase-containing liquid detergent composition in which the surfactant system comprises a mixture of alkyl ethoxy sulfate, ethoxylated nonionic and sulfobetaine species.

Nevertheless,it appears that the efficacy of a zwitterionic detergent in providing enhanced grease and particulate soil removal performance is a function not only of the structure of the zwitterionic surfactant itself, but also of the detergent composition into which it is blended. In particular, it has been found that zwitterionic surfactants that give a suds mileage benefit and/or acceptable greasy soil redeposition performance in one detergent matrix do not give a similar benefit over the same range of usage conditions in other matrices.

The Applicants have now made the discovery that certain narrowly defined classes of betaines provide an unexpected improvement in the soil handling capability of the compositions of the general type disclosed in the previously mentioned European Application No. 0125854.

Accordingly in the present invention there is provided a physically stable enzyme-free liquid detergent composition consisting essentially of from about 22% to about 65% by weight of a surfactant system composed of a mixture of anionic, nonionic and zwitterionic surfactants in an organic solubiliser/hydrotrope-water medium wherein (i) the anionic surfactant comprises in combination
  (a) from about 4% to about 20% by weight of the composition of a primary $C_{10}$–$C_{16}$ alkyl sulfate;
  (b) from about 5% to about 20% by weight of the composition of a $C_{10}$–$C_{16}$ linear alkyl benzene sulfonate;
  (c) from about 5% to about 24% by weight of the composition of a $C_{10}$–$C_{16}$ alkyl ethoxysulfate containing an average of up to about 6 moles of ethylene oxide per mole of ethoxysulfate;

wherein, in said anionic surfactant combination, the cations include magnesium ion in a molar amount corresponding to from about 35% to about 65% of the molar amount of alkyl sulfate present in the combination;

(ii) the nonionic surfactant comprises from about 1% to about 10% by weight of the composition of an ethoxylated $C_6$–$C_{13}$ aliphatic alcohol containing an average of from about 1.5 to about 25 moles of ethylene oxide per mole of alcohol, said ethoxylated alcohol containing not more than about 1% by weight of unethoxylated alcohol where the alcohol contains an average of less than about 9 moles of ethylene oxide and not more than about 2% by weight of unethoxylated alcohol where the ethoxylated alcohol containing an average of from about 9 to about 25 moles of ethylene oxide per mole of alcohol;

(iii) the zwitterionic surfactant comprises from about 0.25% to about 10% by weight of the composition of a compound of the general formula

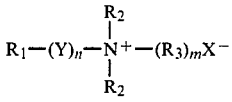

wherein $R_1$ is $C_{10}$–$C_{16}$ alkyl $R_2$ is $C_1$–$C_3$ alkyl $R_3$ is a $—(CH_2)_3$ group or a

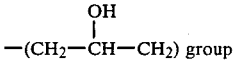

Y is

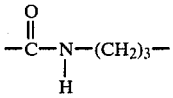

n and m are O or 1

$X^-$ is $CH_2COO^-$ or $SO_3^-$;

provided that where $X^-$ is $CH_2COO^-$ m is O and where $X^-$ is $SO_3^-$ m is 1.

Preferably, in the zwitterionic surfactant, $R_{10}$ is $C_{10}$–$C_{16}$ alkyl, $R_2$ is methyl and n is O and more preferably the zwitterionic surfactant is a $C_{12}$–$C_{14}$ alkyl betaine, present in an amount of from about 0.5% to about 5%, most preferably in an amount of from about 1.0% to about 2.5% by weight of the composition.

Preferably the ethoxylated aliphatic alcohol has an HLB in the range from about 8.0 to about 17.0 more preferably from about 11.0 to about 17.0, and more preferably from about 11.0 to about 15.0. Preferred compositions in accordance with the invention contain from about 3 to about 5% of a $C_9$–$C_{11}$ primary alcohol condensed with an average of about 6 to about 10 moles of ethylene oxide per mole of alcohol. Preferably, the ethoxylated aliphatic alcohol contains less than about 0.7%, most preferably less than about 0.5% of unethoxylated material, and in highly preferred compositions the level of mono-ethoxylated $C_9$–$C_{11}$ alcohol is no more than about 5% by weight of the nonionic surfactant.

One useful group of compositions incorporates a three component anionic surfactant system, comprising 6–12% by weight of the composition of $C_{10}$–$C_{16}$ primary alkyl sulfate, 6–14% of a $C_{10}$–$C_{16}$ primary alkyl ethoxysulfate containing an average of from about 1.5 to about 3 ethoxy groups per alkyl group, and from about 5 to about 15% of a $C_{10}$–$C_{16}$ alkyl benzene sulfonate. The cations in this system are a mixture of ammonium and magnesium ions, the level of magnesium corresponding to approximately one half of the molar amount of alkyl sulfate present.

Highly preferred compositions in accordance with the invention incorporate an anionic surfactant system containing from about 15 to about 20% by weight of the composition of a primary $C_{12}$–$C_{14}$ alkyl ethoxy sulfate stock containing an average of from about 0.8 to about 2.0 ethylene oxide groups per mole of $C_{12}$–$C_{14}$ alkyl ethoxy sulfate, this alkyl ethoxy sulfate stock also including from about 6 to about 10%, by weight of the composition, of $C_{12}$–$C_{14}$ alkyl sulfate, together with from 5 to 10% by weight of the composition of A $C_{11.8}$ linear alkyl benzene sulfonate component.

Preferably compositions in accordance with the invention also contain from about 2% to about 8%, most preferably by 3%–4% by weight of a suds booster selected form $C_{10}$–$C_{16}$ alkyl mono-or di-$C_2$–$C_3$ alkanolamide.

DESCRIPTION OF THE INVENTION

Detergent compositions in accordance with the present invention comprise a mixture of anionic surfactants of defined constitution, in an amount of from about 22% to about 65% by weight of the composition, together with from about 1% to about 10% by weight of an ethoxylated nonionic surfactant having a low content of unethoxylated material and from about 0.25% to about 10% by weight of a zwitterionic surfactant of defined structure.

All compositions in accordance with the invention incorporate an alkyl sulfate and an alkyl benzene sulfonate component in combination with an alkyl ethoxy sulfate.

The alkyl sulfate component is a primary alkyl sulfate in which the alkyl group contains 10'16 carbon atoms, more preferably an average of about 12–14 carbon atoms, preferalby in a linear chain. $C_{10}$–$C_{16}$ alcohols, derived from natural fats or Ziegler olefin build-up or OXO synthesis, form suitable sources for the alkyl group. Examples of synthetically derived materials include Dobanol 23 (RTM) sold by Shell Chemicals (UK) Ltd, Ethyl 24 sold by the Ethyl Corporation, a blend of $C_{13}$–$C_{15}$ alcohols in the ratio 67% $C_{13}$, 33% $C_{15}$ sold under the trade name Lutensol by BASF GmbH and Synperonic (RTM) by ICI Ltd, and Lial 125 sold by Liquichimica Italiana. Examples of naturally occurring materials from which the alcohols can be derived are coconut oil and palm kernel oil and the corresponding fatty acids.

When present in compositions in accordance with the invention, the level of the alkyl sulfate component lies in the range of from about 4% to about 20% by weight of the composition, more generally from about 4% to about 16% by weight. Preferably the usage level lies in the range from about 6% to about 12% by weight, most preferably in the range from about 6% to about 10% by weight.

For the purposes of the present invention, the alkyl sulfate is associated with a source of magnesium ions which, as will be described hereinafter, can either be introduced as the oxide or hydroxide to neutralise the acid or can be added to the composition as a water soluble salt. However the addition of appreciable levels of magnesium salts to the dishwashing compositions of the invention raises the temperature at which inorganic salt crystals form in the compositions on cooling and is therefore less preferable.

The molar amount of magnesium ion in the compositions is controlled to correspond to 0.35–0.65X, preferably 0.45–0.55X where X is the number of moles of $C_{10}$–$C_{16}$ alkyl sulfate present. Most preferably the magnesium ion content is adjusted to provide the stoichiometric equivalent i.e. half the molar amount of the alkyl sulfate present. In practice the magnesium ion will be present at a level of from about 0.15% to about 0.70% by weight, preferably from about 0.25% to about 0.45% by weight of the composition.

Alkyl benzene sulfonates useful in compositions of the present invention are those in which the alkyl group, which is substantially linear, contains 10–16 carbon atoms, preferably 11–13 carbon atoms, a material with an average carbon chain length of 11.8 being most preferred. The phenyl isomer distribution, i.e. the point of attachment of the alkyl chain to the benzene nucleus, is not critical, but alkyl benzenes having a high 2-phenyl isomer content are preferred. When employed in compositions in accordance with the present invention, an alkylbenzene sulfonate content of from about 5% to about 20% by weight of the composition is required generally from about 5% to about 15% by weight. In a preferred aspect of the invention an alkylbenzen sulfonate content of from about 5% to about 10% by weight is used and highly preferred compositions in accordance with this aspect of the invention have from about 6% to about 8% of $C_{11.8}$ alkyl benzene sulfonate.

The alkyl ethoxy sulfate surfactant component comprises a primary alkyl ethoxy sulfate derived from the condensation product of a $C_{10}$–$C_{16}$ alcohol with an average of up to about 6 ethylene oxide groups. The $C_{10}$–$C_{16}$ alcohol itself can be obtained form any of the sources previously described for the alkyl sulfate component. It has, however, been found preferable to use alkyl sulfates and alkyl ether sulfates in which the carbon chain length distributions are the same. $C_{12}$–$C_{13}$ alkyl ether sulfates are preferred and the level of alkyl ethoxy sulfate in the composition lies between about 5% and about 24% by weight of the compositions, generally in the range from about 6% to about 14% by weight. In the preferred compositions, the level lies in the range from about 6% to about 12% by weight, most preferably in the range from about 8% to about 12% by weight.

Conventional base-catalysed ethoxylation processes to produce an average degree of ethoxylation of 6 result in a distribution of individual ethoxylates ranging from about 1 to about 15 ethoxy groups per mole of alcohol, so that the desired average can be obtained in a variety of ways. Blends can be made of material having different degrees of ethoxylation and/or different ethoxylate distributions arising from the specific ethoxylation techniques employed and subsequent processing steps such as distillation. For example, it has been found that equivalent sudsing and grease removal performance to that given by a blend of alkyl sulfate and alkyl triethoxy ether sulfate can be obtained by reducing the level of alkyl sulfate and using an alkyl ether sulfate with an average of approximately two ethoxy groups per mole of alcohol. In preferred compositions in accordance with the present invention the average degree of ethoxylation is from about 0.5 to about 4, more preferably from about 0.8 to about 2.0. When an alkyl ether sulfate stock of low ethoxylation level is employed as a means of incorporating both the alkyl sulfate and alkyl ether sulfate components, the level of its usage in the composition is from about 10% to about 25% by weight, more preferably from about 15% to about 20% by weight.

The counter ion for the alkyl ethoxy sulfate component can be any one of sodium, potassium, ammonium or alkanol-ammonium or a mixture thereof. However, where it is desirable to achieve a low chill point temperature, (the temperature at which inorganic salt crystals separate), a significant proportion (e.g. 30%) of the counter ions for the alkyl ethoxy sulfate component should be ammonium and in order to achieve the lowest possible chill point temperatures the alkyl ethoxy sulfate should be completely neutralized by ammonium ions.

The counter ions in association with the alkyl benzene sulfonate are independently selected in the same manner as those for the alkyl ethoxy sulfate. In order for compositions in accordance with the invention to have a chill point of $\leqq 0°$ C., at least about 70% of the neutralising cations for the anionic surfactants should be ammonium ions.

The ethoxylated nonionic surfactant compoennt of the invention is a $C_6$–$C_{13}$ aliphatic alcohol ethoxylate containing an average of from about 1.5 to about 25, more preferably from about 2 to about 15 and most preferably from about 6 to about 10 moles of ethylene oxide per mole of alcohol. The aliphatic alcohol ethoxylate contains not more than about 1% by weight of unethoxylated alcohol where the ethoxylated alcohol contains an average of less than about 9 moles of ethylene oxide and not more than about 2% by weight of unethoxylated alcohol where the ethoxylated alcohol contains an average of from about 9 to about 25 moles of ethylene oxide per mole of alcohol.

The starting alcohol may be a primary alcohol or secondary but is preferably a primary alcohol which may be derived from natural or synthetic sources. Thus natural fats or oils, or products of Ziegler olefin build up reactions or OXO synthesis may all be used as the source of the hydrocarbon chain, the structure of which may be linear or branched in type.

The preferred alcohol chain length range is from $C_9$ to $C_{11}$ as it has been found that the sudsing volume and mileage performance of compositions in accordance with the invention is optimum when incorporating ethoxylates made from such alcohols. It is also desirable for performance reasons that the hydrophilic-lipophilic balance (HLB) of the ethoxylated alcohol is in the range from about 8.0 to about 17.0, more preferably from about 11.0 to about 17.0 and most preferably from about 11.0 to about 15.0.

As discussed with respect to the alkyl ethoxy sulfate component, the normal (base catalysed) ethoxylation process to produce an average degree of ethoxylation of 6 results in a distribution of ethoxylate species which ranges from about 1 to about 15 moles of ethylene oxide per mole of alcohol. An increase in $E_{av}$ causes some change in this distribution, principally a reduction in the level of unethoxylated material, but an increase in $E_{av}$ from about 3 to about 5 will still leave approximately 5'10% of such material in the ethoxylated product.

In the liquid dishwashing detergent compositions of the invention, this level of unethoxylated material will give rise to phase stability/chill point problems and/or will result in a product having a fatty alcohol odour which is unacceptable to consumers and cannot be masked by conventional detergent perfumes. It has been found that the maximum level of unethoxylated alcohol that can be tolerated in the ethoxylated alcohol component is about 1% by weight. More preferably the unethoxylated alcohol level is not more than about 0.7% and most preferably is less than 0.5% by weight of the ethoxylated alcohol component. Distillation under vacuum is employed to remove the undesired material and this also removes a portion of the monoexthoxylate fraction, thereby increasing the $E_{av}$ of the remaining material. In preferred embodiments of the invention the level of monoethoxylate is not more than about 5% by weight of the ethoxylated alcohol.

The level of usage of the ethoxylated alcohol component in compositions of the invention is from about 1% to about 10% by weight more preferably from 2 to 6% by weight and most preferably from about 3% to about 5% by weight. Liquid dishwashing detergent compositions in accordance with the invention and incorporating from about 3% to about 5% by weight of a primary alcohol containing from about 9 to about 11 carbon atoms condensed with an average of from about 5 to about 10 moles ethylene oxide per mole of alcohol to give an HLB value in the range of from about 12 to about 15, the alcohol ethoxylate containing <0.5% by weight of unethoxylated alcohol, display chill points <0° C. together with enhanced sudsing and mileage performance relative to compositions not in accordance with the invention.

The third component of the compositions of the invention is a zwitterionic surfactant, present in an amount of from about 0.25% to about 10%, more preferably from about 0.5% to about 5% and most preferably from about 1% to about 2.5% by weight of the compositions.

The zwitterionic surfactant has the general formula:

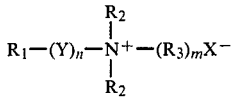

wherein $R_1$ is $C_{10}$–$C_{16}$ alkyl $R_2$ is $C_1$–$C_3$ alkyl $R_3$ is a $—(CH_2)_3$ group or a

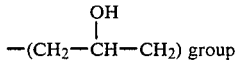

Y is

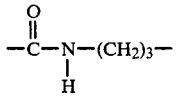

n and m are O or 1

$X^-$ is $CH_2COO^-$ or $SO_3^-$;

provided that where $X^-$ is $CH_2COO^-$ m is O and where $X^-$ is $SO_3^-$ m is 1.

More preferably $R_1$ has an average carbon chain length of from 12 to 14 carbon atoms and may be derived from synthetic sources, in which case the chain may incorporate some branching, or from natural fats and oils, in which case the chains are linear and may include minor amounts of $C_8$–$C_{10}$ and $C_{14}$–$C_{18}$ moieties. Synthetic sources for the $R_1$ group may be the same as those mentioned previously for the alkyl group in the alkyl sulfate component.

Whilst compositions incorporating the $C_{12}$–$C_{14}$ amido betaine and $C_{12}$–$C_{14}$ sulfo betaine display the benefits of the invention, the most preferred compositions utilise a $C_{12}$–$C_{14}$ alkyl betaine as the zwitterionic surfactant component, the $C_{12}$–$C_{14}$ alkyl group being derived from a coconut or palm kernel oil feedstock.

A highly preferred optional ingredient of the composition according to the invention is a suds-promoting agent present at a level of from about 2% to about 8% by weight of the composition, preferably from about 3% to about 6% and most preferably 3%–4%.

The suds-promoting agent is normally a $C_{10}$–$C_{16}$ alkyl mono- or di-$C_2$–$C_3$ alkanolamide, examples including coconut alkyl monoethanolamide, coconut alkyl diethanolamide and palm kernel and coconut alkyl mono-and di-isopropanol amides. The palm kernel or coconut alkyl residue may either be 'whole cut', including the $C_{10}$ and $C_{16}$ fractions or may be the so-called 'narrow-cut' $C_{12}$–$C_{14}$ fraction. Synthetic sources of the $C_{10}$–$C_{16}$ alkyl group can also be used.

The balance of the formula comprises a hydrotrope-water system in which the hydrotrope may be urea, a $C_1$–$C_3$ aliphatic alcohol, a lower alkyl or dialkyl benzene sulfonate salt such as toluene sulfonate, xylene sulfonate, or cumene sulfonate, or mixtures of any of these. Normally a single hydrotrope will be adequate to provide the required phase stability, but compositions in accordance with the present invention preferably employ a mixture such as urea-alcohol-water, alcohol-lower alkyl benzene sulfonate-water of urea-lower alkyl benzene sulfonate-water in order to achieve the desired viscosity, and to remain stable and easily pourable. For compositions having an organic active concentration less than about 40% by weight, the preferred alcoholic hydrotrope is ethanol which is employed at from about 3% to about 10% by weight of the composition, preferably at from about 4% to about 8%, usually in admixture with urea. For compositions having an organic active concentration greater than about 40% by weight, mixtures of ethanol with urea and/or lower alkyl benzene sulfonate are preferred. Mixtures of hydrotopes can, of course, be employed for cost effectiveness reasons irrespective of any stability/viscosity considerations.

Optional ingredients of the liquid detergent compositions of the invention include opacifiers such as ethylene glycol distearate, thickeners such as guar gum, antibacterial agents such as glutaraldehyde and Bronopol (RTM), antitarnish agents such as benzoxytriazole, heavy metal chelating agents such as ETDA or ETDMP, perfumes and dyes. The pH of the compositions may be anywhere within the range from about 6 to about 7.5 but as manufactured the compositions normally have a pH in the range 6.6–7.3 and are subjected to a final pH trimming operation to obtain the desired finished product pH. For coloured products the pH preferably lies in the range 6.5–6.9 in order to maintain colour stability.

The compositions of the invention can be made in a number of ways but it is preferred that the zwitterionic surfactant is incorporated towards the end of the making process if not actually forming the last ingredient to be added. This minimises the risk of any degradation of the zwitterionic surfactant under the acid conditions existing at the beginning of the making process and also facilitates the control of the viscosity of the finished product.

Thus, individual anionic surfactants can be made as aqueous solutions of alkali metal or ammonium salts which are then mixed together with the ethoxylated nonionic surfactant, followed by the suds booster and the hydrotrope, after which any magnesium ion can be introduced as a water soluble salt such as the chloride or sulfate. The zwitterionic surfactant and any optional minor ingredients are then added at the same time as the pH and viscosity are adjusted. This method has the advantage of utilising conventional techniques and equipment but does result in the introduction of additional chloride or sulfate ions which can increase the chill point temperature (the temperature at which inorganic salts precipitate as crystals in the liquid).

In order to simplify the making process the alcohol and alcohol ethoxylate can be mixed together and a single sulfation and neutralisation can then be carried out on these two materials. For this, the alcohol and alcohol ethoxylate should be mixed in a weight ratio lying in the range 4:3 to 1:6. In the most preferred technique however, a single alcohol ethoxylate stock is produced in which the levels of alcohol and ethoxylated alcohol species are controlled to provide the desired ratio of these starting materials.

Sulf(on)ation of the alcohol, alcohol ethoxylate and alkyl benzene can employ any of the conventional sulf(on)ating agents such as sulfur trioxide or chlorosulfonic acid. Neutralisation of the alkyl ether sulfuric acid and the alkyl sulfuric acid is then carried out with the appropriate alkali or with a magnesium oxide or hydroxide slurry which avoids the addition of chloride or sulfate ions.

In one variant of this technique the alkyl benzene sulfonic acid is added to a neutralising medium, comprising ammonium hydroxide in an ethanol-water solution, to which the ethoxylated nonionic surfactant has also been added. This paste then forms a 'heel' to which the suds booster and a magnesium hydroxide slurry are added followed by the mixed alkyl sulfuric and alkyl ether sulfuric acids. The neutralisation of the alkyl sulfate and alkyl ether sulfate actives is carried out to a pH<4 in order to ensure dissolution of the magnesium hydroxide, after which the pH is adjusted to the finished product pH of 6.6–7.3 and the minor ingredients (colour, perfume, bactericides etc.) are added before the zwitterionic component is blended and final adjustment of the viscosity is carried out.

A further and preferred variation involves the neutralisation of the mixed alkyl sulfuric and alkyl ether sulfuric acids in the alcoholic ammonia solution and the use of this paste, at a surfactant concentration of from about 40 to about 60% by weight and a pH of from about 7 to about 8, as the 'heel' to which the monoethanolamide suds booster, magnesium hydroxide slurry and alkyl benzene sulfonic acid are added. The pH of the system after the sulfonic acid is added must be in the range of from 2 to 4 to ensure complete dissolution of the magnesium hydroxide. The minor ingredient addition, pH trimming, zwitterionic surfactant incorporation and viscosity adjustment are as before.

Preferred compositions in accordance with the invention are clear single phase liquids, but the invention also embraces opaque products containing dispersed phases provided that such products are physically stable (i.e., do not separate) on storage.

The invention is illustrated in the following non-limitative examples in which all parts and percentages are by weight unless otherwise specified.

EXAMPLE 1

The following compositions were prepared:

| | A | B | C | D | E | F | G | H |
|---|---|---|---|---|---|---|---|---|
| Ammonium $C_{11.8}$ linear alkyl benzene sulfonate | 13.5 | 13.5 | 13.5 | 13.5 | 13.5 | 13.5 | 13.5 | 13.5 |
| Ammonium $C_{12-13}$ alkyl $(EO)_2$ sulfate | 9.9 | 9.9 | 9.9 | 9.9 | 9.9 | 9.9 | 9.9 | 9.9 |
| Magnesium $C_{12}$–$C_{13}$ alkyl sulfate | 8.2 | 8.2 | 8.2 | 8.2 | 8.2 | 8.2 | 8.2 | 8.2 |
| Primary alcohol ethoxylate[1] | — | — | — | — | 4.7 | 4.7 | 4.7 | 4.7 |
| Zwitterionic surfactant | — | 0.75 | 1.5[2] | 2.25[2] | — | 1.5[2] | 1.5[3] | 1.5[4] |
| Coconut Monoethanolamide | 3.8 | 3.8 | 3.8 | 3.8 | 3.8 | 3.8 | 3.8 | 3.8 |
| Ethanol | 9.0 | 9.0 | 9.0 | 9.0 | 4.0 | 4.0 | 4.0 | 4.0 |
| Water | | | | to 100 | | | | |

[1]A predominantly linear $C_9$–$C_{11}$ alcohol blend containing an average of 10 ethylene oxide units per mole of alcohol, and containing less than 2% by weight of unethoxylated alcohol.
[2]A Coconut amido propyl betaine in which >70% by weight of the alkyl groups comprise $C_{12}$ or $C_{14}$ radicals.
[3]A Coconut alkyl sulfobetaine in which >95% by weight of the alkyl group comprise $C_{12}$ or $C_{14}$ radicals.
[4]A Coconut alkyl betaine in which >95% by weight of the alkyl groups comprise $C_{12}$ or $C_{14}$ radicals.

In the preparation of Compositions A–D, a mixture of alcohol and alcohol ethoxylate was sulfated using $SO_3$-air sulfation, and was then neutralised to a solution pH of 4 in an alcoholic ammonium hydroxide solution to which magnesium hydroxide had been added in an amount corresponding to half the molar quantity of alkyl sulfate present. After dissolution of the magnesium hydroxide, ammonia was added to form a neutralising solution for the alkyl benzene sulfonic acid. A separate sulfonation of the alkyl benzene was employed to produce the alkyl benzene sulfonic acid which was added to the alkaline solution of the other actives and neutralised with the excess ammonia to pH 7. The monoethanolamide and, where present, the betaine were then added before final pH trimming to pH 6.8. The chill point of Composition A was −5° C. Compositions incorporating ethoxylated nonionic surfactant (i.e. E–H) were prepared in a similar manner except that the ethoxylated nonionic surfactant was added during the final pH trimming operation.

A comparison of the suds mileage of the compositions under identical conditions was made using a prepared particulate soil and a prepared grease soil in the mechanical sudsing test method described.

| | |
|---|---|
| Test Conditions | |
| Product Concentration | 0.12% |
| Water Temperature | 47° C. |
| Water Hardness | 2° H. and 18° H. |
| Particulate soil | |
| Soil: Cake Mix/Mixed free fatty acids (MFFA) | |
| The Cake Mix is McDougall's Sponge Mix | |
| The free fatty acids comprise | 2 parts oleic acid<br>2 parts linoleic acid<br>1 part stearic acid<br>2.5 parts palmitic acid |

-continued

| | |
|---|---|
| | 367 parts corn oil |
| to give 2% MFFA mixture. | |
| Grease soil | |
| | 6 parts palmitic acid<br>94 parts corn oil |
| to give 6% FA soil | |

TEST METHOD

The method uses 4 cylinders of length 30 cm and diameter 10 cm fixed side by side, and rotatable at a speed of 24 rpm about a central axis. Each cylinder is charged with 500 mls of product solution at a concentration of 0.12% and a temperature of 47° C. The outer two cylinders are used for one of the products being compared and the inner two for the other product.

The cylinders are rotated for 2 minutes, stopped, the initial suds are measured and a soil load is then added. In the particulate soil test all of the Cake Mix soil (5 g) is added together at this stage with 1 ml of the 2% MFFA. In the grease soil test 1 ml of the 6% FA soil alone is added. After 1 minute the cylinders are restarted and allowed to rotate for 1 minute. The suds height is noted and 1 ml of the 2% MFFA or 6F FA (depending on the test) is added to each cylinder. After 1 minute the cylinders are restarted. This process continues until the suds height in the cylinder is lower than 0.3 cms.

One product is designated as the control and suds mileage figures are calculated for the other product versus the 'control' product on the following basis.

$$\text{Mileage of test product} = \frac{\text{number of soil additions to test product solution to reduce suds height to 0.3 cm}}{\text{number of soil additions to control product to reduce suds height to 0.3 cm}} \times 100$$

The results of various mileage comparisons were as follows;

(1) Comparison of compositions A–D using composition A as control (i.e. 100%):

| | Particulate soil Mileage | | Grease soil Mileage | |
|---|---|---|---|---|
| | 2° H. | 18° H. | 2° H. | 18° H. |
| A | 100 | 100 | 100 | 100 |
| B | 110 | 113 | — | — |
| C | 128 | 104 | 114 | 113 |
| D | 125 | 105 | — | — |

(2) Comparison of compositions A, C and E–H using composition E as control (i.e. 100%):

| | Particulate soil Mileage | | Grease soil Mileage | |
|---|---|---|---|---|
| | 2° H. | 18° H. | 2° H. | 18° H. |
| A | 80 | 80 | 80 | 80 |
| C | 108 | 84 | 94 | 100 |
| E | 100 | 100 | 100 | 100 |
| F | 125 | 125 | 123 | 107 |
| G | 125 | 137 | 122 | 109 |
| H | 150 | 136 | 135 | 128 |

A comparison of the performance of compositions A–D shows that little, if any, benefit is obtained from increasing zwitterionic level above 1.5% by weight of the composition.

It can be seen that in a comparison of the mileage performance of compositions A, C, E and F, the addition of 1.5% betaine to composition A to form composition C does not produce as great an overall mileage benefit as does the addition of 4.7% alcohol to composition A to form composition E. Addition of betaine to composition E to form composition F provides, overall, a greater benefit than that arising from adding betaine to composition A to form composition C. Comparison of the mileage performance of compositions E–H show that whilst both the amido betaine-containing composition F and the sulfobetaine containing composition both show significant advantages over the base composition E, the alkyl betaine-containing composition H is much superior to the other two.

EXAMPLE 2

Products were made using the process of Example 1 having the following compositions:

| | I | J | K | L | M |
|---|---|---|---|---|---|
| Ammonium $C_{11.8}$ Linear 10alkyl benzene sulfonate | 14.3 | 14.3 | 14.8 | 6.0 | — |
| $C_{12}$–$C_{13}$ alkyl $(EO)_{0.8}$ sulfate[1] comprising approximately 57% by weight of $C_{12}$–$C_{13}$ alkyl sulfate | 16.8 | 16.8 | 17.3 | 20.0 | 25.0 |
| Primary alcohol ethoxylate[2] | 4.7 | 4.7 | 4.7 | 4.7 | 4.7 |
| Coconut monoethanol amide | 3.8 | 3.8 | 3.8 | 3.8 | 3.8 |
| Zwitterionic surfactant[3] | — | 1.5 | 1.5 | 1.5 | 1.5 |
| Solubiliser system[4] | 9.0 | 9.0 | 9.0 | 9.0 | 9.0 |
| Water | | | to 100 | | |

[1]Associated with a mixture of Magnesium and Ammonium ions, the amount of magnesium corresponding to half the molar level of alkyl sulfate present

[2]A predominantly linear $C_9$–$C_{11}$ alcohol blend containing an average of 10 ethylene oxide units per mole of alcohol, and containing less than 2% by weight of unethoxylated alcohol.

[3]A Coconut alkyl betaine in which >95% by weight of alkyl groups comprise $C_{12}$ or $C_{14}$ radicals.

[4]5% Ethanol 4% urea.

The performance of the above products was then assessed using the test methods identified below:

1. Grease Cutting 8.5 cm dia metal dishes each containing 5 ml of solidified household fat (Mpt>45° C.), as a uniform thickness layer, were suspended in a 0.12% solution of each product at 45° C. for 30 minutes. The fat released by each product solution was collected via an inverted funnel immersed in the solution and overlying the dish. The weight of the fat released and collected was measured. Tests were carried out in both 2° H. and 18° H. water and the average of the measured fat weight in the two water hardnesses calculated for each product. This was then compared to that released by the standard product I and expressed as an Index Value relative to product I at 100.

2. Grease Redeposition

Clean ceramic slides were dipped into product solutions comprising 500 mls of 0.12% wt concentration in 2° H. and 18° H. water containing 5 mls household fat soild which had been mixed at 45° C. for 2 minutes. The slides were withdrawn and compared and graded visually by an expert panel. The results were recorded in terms of panel score units of a Scheffè scale and the average of the results for each roduct in the two water hardnesses were expressed as better than, or poorer than, the standard product I.

3. Initial Suds

A model test was employed in which product solutions of 0.12% concentration at 45° C. with no soil present were subjected to impact by pouring 4.5 liters of water at 45° C. on to the solution from a height of 20 cm in a 9 liter graduated bowl. The height of the suds generated by this technique was found to be correlatable to the initial suds experienced by consumers in use. The performance of each product was expressed as better than, or poorer than, that of the standard product I.

4. Suds Mileage

This was carried out as described in Example 1 except that the grease soil comprised 5% of a mixture of fatty acids and 95% corn oil by weight, the mixture of fatty acids comprising 2 parts oleic acid, 2 parts linoleic acid, 1 part stearic acid and 2.5 parts palmitic acid. Product I was used as the standard.

The results were as follows:

| | I | J | K | L | M |
|---|---|---|---|---|---|
| Grease Cutting | 100 | 150 | 150 | 150 | 150 |
| Grease Redeposition | STD | POORER | POORER | BETTER | BETTER |
| Initial Suds STD | −VE | STD | STD | STD | |
| Mileage (2° H./18° H.): | | | | | |
| Grease | 100/100 | 122/114 | 160/130 | 154/135 | 70/87 |
| Particulate | 100/100 | 150/136 | 133/120 | 128/132 | 108/108 |

It can be seen that Products J, K and L in accordance with the invention, although providing the suds mileage benefits of the invention, do not all perform equally well in other areas. Product J, which comprises the addition of 1.5% alkyl betaine to Product I, improves suds mileage and grease cutting but shows technical deficiencies in initial suds level and grease redeposition. A more preferred embodiment Product K, in which the anionic surfactant level has been slightly increased, eliminates the initial suds performance deficiency of Product J. A highly preferred embodiment of the invention is constituted by Product L, in which the ratio of alkyl benzene sulfonate to alkyl sulfate/alkyl ether sulfate has been significantly reduced. This formulation demonstrates improved grease redeposition performance relative to the other products, whilst employing a lower total level of anionic surfactant. However, elimination of the alkyl benzene sulfonate component and an increase in the level of the alkyl sulfate/alkyl ether sulfate component to give a formulation of equal cost (Product M) shows a marked decline in suds mileage performance, particularly on greasy soils, where the performance is worse than that of the reference product I.

What we claim is:

1. A physically stable enzyme-free liquid detergent composition consisting essentially of from about 22% to about 65% by weight of a surfactant system composed of a mixture of anionic, nonionic and zwitterionic surfactants in an organic solubiliser/hydrotrope-water medium wherein (i) the anionic surfactant comprises in combination (a) from about 4% to about 20% by weight of the composition of a primary $C_{10}$–$C_{16}$ alkyl sulfate;

(b) from about 5% to about 20% by weight of the composition of a $C_{10}$–$C_{16}$ linear alkyl benzene sulfonate;

(c) from about 5% to about 24% by weight of the composition of a $C_{10}$–$C_{16}$ alkyl ethoxysulfate containing an average of up to about 6 moles of ethylene oxide per mole of ethoxysulfate;

wherein, in said anionic surfactant combination, the cations include magnesium ion in a molar amount corresponding to from about 35% to about 65% of the molar amount of alkyl sulfate present in the combination;

(ii) the nonionic surfactant comprises from about 1% to about 10% by weight of the composition of an ethoxylated $C_6$–$C_{13}$ aliphatic alcohol containing an average of from about 1.5 to about 25 moles of ethylene oxide per mole of alcohol, said ethoxylated alcohol containing not more than about 1% by weight of unethoxylated alcohol where the alcohol contains an average of less than about 9 moles of ethylene oxide and not more than about 2% by weight of unethoxylated alcohol where the ethoxylated alcohol containing an average of from about 9 to about 25 moles of ethylene oxide per mole of alcohol;

(iii) the zwitterionic surfactant comprises from about 0.25% to about 10% by weight of the composition of a compound of the general formula

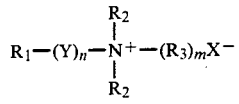

wherein $R_1$ is $C_{10}$–$C_{16}$ alkyl $R_2$ is $C_1$–$C_3$ alkyl $R_3$ is a '$(CH_2)_3$ group or a

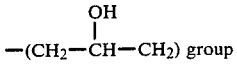

Y is

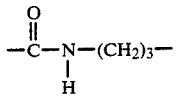

n and m are O or 1

$X^-$ is $CH_2COO^-$ or $SO_3^-$;

provided that where $X^-$ is $CH_2COO^-$, m is O and where $X^-$ is $SO_3^-$, m is 1, and wherein said organic solubilizer/hydrotrope-water medium is the balance of the formula and said organic solubilizer/hydrotrope is selected from the group consisting of urea, a $C_1$–$C_3$ aliphatic alcohol, a lower alkyl or dialkyl benzene sulfonate salt, and mixtures of the above.

2. A detergent composition according to claim 1 wherein the anionic surfactant combination comprises from about 6% to about 12% of a $C_{12}$–$C_{14}$ alkyl sulfate, from about 5% to about 15% of a $C_{11}$–$C_{13}$ alkyl benzene sulfonate and from about 6% to about 1% of a $C_{12}$–$C_{14}$ alkyl ethoxysulfate containing an average of not more than about 2 ethoxy groups per mole of ethoxy sulfate, the cations in said combination including magnesium ion in a molar amount corresponding to approximately 50% of the molar amount of alkyl sulfate present in the combination.

3. A detergent composition according to claim 2 wherein the alkyl sulfate and alkyl ethoxysulfate components are provided by a single alkyl ethoxysulfate stock containing an average of from about 0.8 to about 2.0 ethoxy groups per mole of alkyl ethoxy sulfate, said single stock being present in an amount of from about 10% to about 25% by weight of the composition.

4. A detergent composition according to claim 3 wherein the anionic surfactant combination comprises from about 5% to about 10% by weight of a $C_{11}$–$C_{13}$ linear alkyl benzene sulfonate and from about 15% to about 20% by weight of $C_{12}$–$C_{14}$ linear alkyl ethoxy sulfate containing approximately 0.8 ethoxy groups per mole of alkyl ethoxy sulfate.

5. A detergent composition according to claim 1 wherein the nonionic surfactant has an HLB in the range from 8.0 to 17.0.

6. A detergent composition according to claim 5 wherein the nonionic surfactant comprises from about 2% to about 6% of a linear $C_9$–$C_{11}$ alcohol containing an average of from about 6 to about 10 moles of ethylene oxide per mole of alcohol.

7. A detergent composition according to claim 6 wherein the zwitterionic surfactant is 1(N, N dimethyl N-$C_{12}$–$C_{14}$ alkyl ammonio) methane-1-carboxy and comprises from about 1% to about 5% by weight of the composition.

* * * * *

UNITED STATES PATENT AND TRADEMARK OFFICE

CERTIFICATE OF CORRECTION

PATENT NO. : 4,671,894

DATED : June 9, 1987

INVENTOR(S) : Christopher Lamb, John R. Lawson, Carol Pearson

It is certified that error appears in the above-identified patent and that said Letters Patent are hereby corrected as shown below:

Col. 3, line 34, "$R_{10}$" should read --$R_1$--.

Col. 4, line 29, "10'6" should read --10-16--.

Col. 6, line 54, "5'10%" should read --5-10%--.

Col. 8, line 24, "water of urea" should read --water or urea--.

Col. 11, line 25, "6F FA" should read --6% FA--.

Col. 12, line 14, "composition both" should read --composition G both--.

Signed and Sealed this

Sixteenth Day of February, 1988

*Attest:*

DONALD J. QUIGG

*Attesting Officer*

*Commissioner of Patents and Trademarks*